US009121280B2

(12) United States Patent
Benjamin et al.

(10) Patent No.: US 9,121,280 B2
(45) Date of Patent: Sep. 1, 2015

(54) TIE SHAFT ARRANGEMENT FOR TURBOMACHINE

(75) Inventors: Daniel Benjamin, Simsbury, CT (US); Brian C. Lund, Moodus, CT (US)

(73) Assignees: UNITED TECHNOLOGIES CORPORATION, Hartford, CO (US); MTU AERO ENGINES AG, München (DE)

( * ) Notice: Subject to any disclaimer, the term of this patent is extended or adjusted under 35 U.S.C. 154(b) by 633 days.

(21) Appl. No.: 13/442,078

(22) Filed: Apr. 9, 2012

(65) Prior Publication Data

US 2013/0266421 A1 Oct. 10, 2013

(51) Int. Cl.

| | |
|---|---|
| ***F01D 25/00*** | (2006.01) |
| ***F01D 5/02*** | (2006.01) |
| ***F01D 5/06*** | (2006.01) |

(52) U.S. Cl.

CPC ..... *F01D 5/026* (2013.01); *F01D 5/066* (2013.01)

(58) Field of Classification Search

CPC ..... F01D 5/022; F01D 5/025; F01D 5/026; F01D 5/027; F01D 5/066

USPC ..... 416/198 A, 201 R, 204 A, 244 A; 415/198.1, 216.1

See application file for complete search history.

(56) References Cited

U.S. PATENT DOCUMENTS

| | | | | |
|---|---|---|---|---|
| 3,765,795 | A * | 10/1973 | Koff | 416/198 R |
| 4,247,256 | A * | 1/1981 | Maghon | 416/198 A |
| 5,031,400 | A | 7/1991 | Boyd | |
| 7,147,436 | B2 * | 12/2006 | Suciu et al. | 415/216.1 |
| 2007/0297897 | A1 * | 12/2007 | Tran et al. | 415/170.1 |
| 2010/0124495 | A1 | 5/2010 | Bifulco | |
| 2010/0158699 | A1 | 6/2010 | Makuszeski | |
| 2010/0239424 | A1 | 9/2010 | Maalouf et al. | |
| 2011/0219781 | A1 | 9/2011 | Benjamin et al. | |
| 2011/0223026 | A1 | 9/2011 | Benjamin et al. | |

OTHER PUBLICATIONS

International Search Report and Written Opinion for International Application No. PCT/US2013/035086 completed on Jan. 13, 2014.

International Preliminary Report on Patentability for PCT Application No. PCT/US2013/035086, mailed Oct. 23, 2014.

Extended European Search Report for Application No. 13813873.0 dated Apr. 22, 2015.

* cited by examiner

*Primary Examiner* — Igor Kershteyn

(74) *Attorney, Agent, or Firm* — Carlson, Gaskey & Olds, P.C.

(57) ABSTRACT

A turbomachine includes a tie shaft extending along an axis. Multiple rotors are mounted on the tie shaft. First and second clamping members are secured to the tie shaft and exert a clamping load between the rotors and clamping members at multiple interfaces. The clamping load at one of the interfaces includes a radial clamping load of greater than 5% of a total design clamping load at the one interface. In one example, one of the clamping members is provided by a hub including a first leg extending between first and second opposing ends. The first end provides a flange configured to be supported by the tie shaft. The second end includes first and second hub surfaces respectively extending in radial and axial directions. The first leg is inclined between 15° and 75° relative to the axial direction.

13 Claims, 2 Drawing Sheets

TIE SHAFT ARRANGEMENT FOR TURBOMACHINE

BACKGROUND

This disclosure relates to an axial flow turbomachine, such as a gas turbine engine. More particularly, the disclosure relates to a tie shaft arrangement used to clamp multiple rotors together and transmit torque.

A turbomachine typically includes at least one compressor stage followed by at least one turbine stage. One type of turbomachine is a radial flow turbomachine having a compressor section in which axial flow is compressed and expelled from the compressor section in a radial direction to produce a compressed radial flow.

One prior art radial flow compressor section includes multiple compressor stages secured for rotation using a tie shaft arrangement. In such an arrangement, multiple, discrete compressor rotors are clamped between two clamping members mounted to the tie shaft. Each rotor supports circumferentially mounted blades, which impart torque on the rotor. In one example, at least one of the clamping members is a threaded element, such as a nut which is tightened onto the tie shaft to generate axial clamping load on the rotors that enables torque transmission. A hub may be used between the nut and rotor as well. Prior art tie shaft arrangements have relied entirely upon axial clamping loads to enable torque transmission between adjacent rotors.

SUMMARY

A turbomachine includes a tie shaft extending along an axis. Multiple rotors are mounted on the tie shaft. First and second clamping members are secured to the tie shaft and exert a clamping load between the rotors and clamping members at multiple interfaces. The clamping load at one of the interfaces includes a radial clamping load of greater than 5% of a total design clamping load at the one interface.

In a further embodiment of any of the above, the radial clamping load is up to 40% of the total design load with a balance of the total clamping load having an axial clamping load.

In a further embodiment of any of the above, the tie shaft is a high pressure spool.

In a further embodiment of any of the above, the rotors are high pressure compressor rotors.

In a further embodiment of any of the above, one of the rotors includes first and second rotor surfaces respectively that provide radially and axially extending surfaces, the radial clamping load exerted on the second rotor surface.

In a further embodiment of any of the above, the first rotor surface is arranged radially inward of the second rotor surface.

In a further embodiment of any of the above, one of the first and second clamping members is a hub that provides first and second hub surfaces that respectively engage the first and second rotor surfaces to produce the total clamping load.

In a further embodiment of any of the above, the hub includes a first leg having opposing first and second ends. The second end provides the first and second hub surfaces. The first end provides a flange supported by the tie shaft.

In a further embodiment of any of the above, the tie shaft includes a threaded surface having a nut secured to the threaded surface and configured to apply the clamping load through the first end.

In a further embodiment of any of the above, the first leg is inclined between 15° and 75° relative to the axis.

In a further embodiment of any of the above, the hub includes a second leg joined to the first leg. The hub is arranged between compressor and turbine sections and is configured respectively to provide compressor and turbine clamping loads to the compressor and turbine sections.

In a further embodiment of any of the above, a friction modifier is provided at the interface.

In one example, one of the clamping members is provided by a hub including a first leg extending between first and second opposing ends. The first end provides a flange configured to be supported by the tie shaft. The second end includes first and second hub surfaces respectively extending in radial and axial directions. The first leg is inclined between 15° and 75° relative to the axial direction.

In a further embodiment of any of the above, the hub includes a second leg integral with the first leg and extends generally in the axial direction from a joint arranged between the first and second ends to a third end.

In a further embodiment of any of the above, a friction modifier is provided on at least one of the first and second hub surfaces.

BRIEF DESCRIPTION OF THE DRAWINGS

The disclosure can be further understood by reference to the following detailed description when considered in connection with the accompanying drawings wherein.

DETAILED DESCRIPTION

Figure 1:
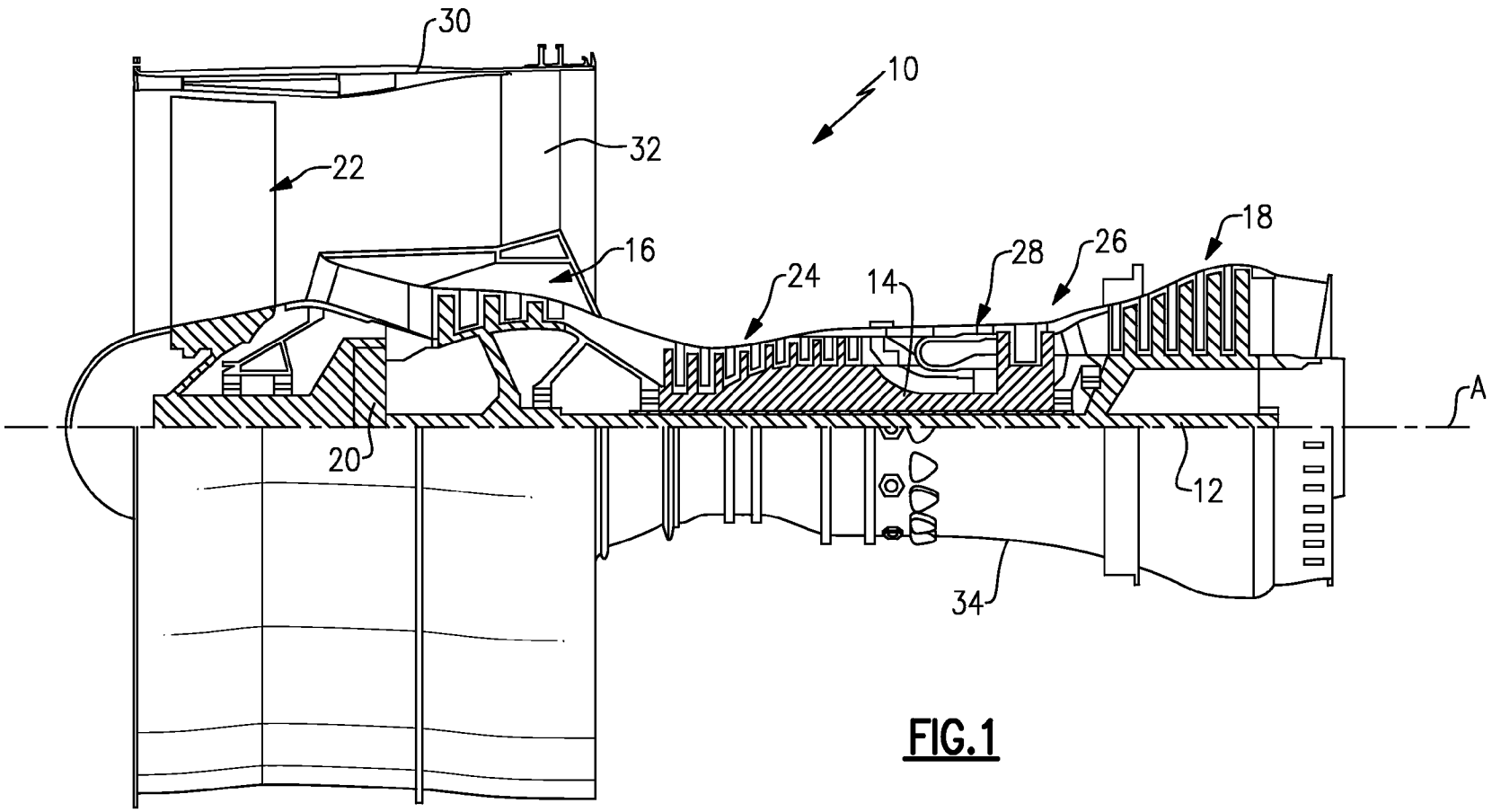
FIG. 1 is a schematic cross-sectional view of an example gas turbine engine.

One example gas turbine engine 10 is schematically illustrated in FIG. 1. The engine 10 includes low and high spools 12, 14 rotatable about a common axis A. Although a two spool arrangement is illustrated, it should be understood that additional or fewer spools may be used in connection with the disclosed tie shaft arrangement.

A low pressure compressor section 16 and a low pressure turbine section 18 are mounted on the low spool 12. A gear train 20 couples the low spool 12 to a fan section 22, which is arranged within a fan case 30. It should be understood that the disclosed tie shaft arrangement may be used with other types of engines.

A high pressure compressor section 24 and a high pressure turbine section 26 are mounted on the high spool 14. A combustor section 28 is arranged between the high pressure compressor section 24 and the high pressure turbine section 26. The low pressure compressor section 16, the low pressure turbine section 18, the high pressure compressor section 24, the high pressure turbine section 26 and the combustor section 28 are arranged within a core case 34.

The engine 10 illustrated in FIG. 1 provides an axial flow path through the core case 34. A tie shaft 36 provides the high spool 14 in the example illustrated, although the disclosed tie shaft may be used for other spools. The disclosed clamping arrangement can be used in compressor and/or turbine sections of the engine 10. In the disclosed example tie shaft arrangement, multiple high pressure compressor rotors 38A, 38B, 38C and 38D, collectively referred to as "rotors 38," of the high pressure compressor section 24 are clamped to one another to secure the rotors 38 to the tie shaft 36 and transmit torque. Turbine rotors 62, 63 of the high pressure turbine section 26 are similarly secured to the tie shaft 36.

Figure 2:
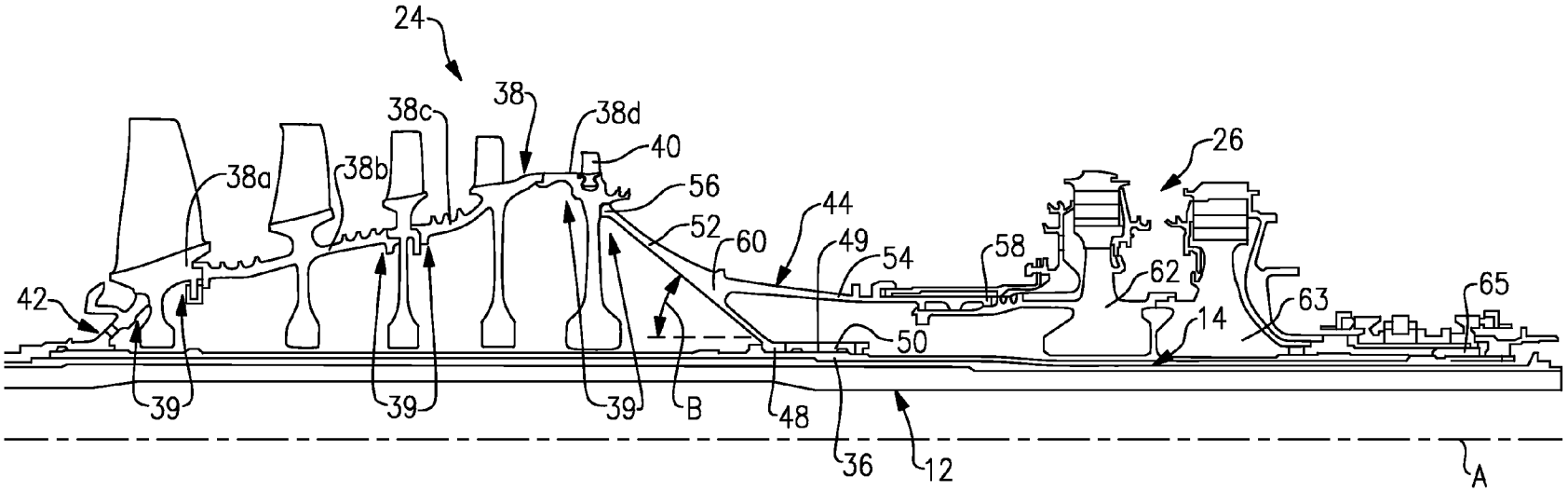
FIG. 2 is an enlarged cross-sectional view of an example tie shaft arrangement.

Referring to the FIG. 2, the high pressure compressor section 24 is illustrated in more detail. The rotors 38 support airfoils that generate torque; airfoils can be either integral like 38*a*, 38*b* and 38*c* or separated like blades 40. First and second clamping members 42, 44 are secured to the tie shaft 36 and exert a clamping load between the rotors 38 and clamping members 40, 42 at multiple interfaces 39 between these components. The torque is transmitted from rotor to rotor through the friction between the axial and radial interfaces.

In the example, a first clamping member 42 is provided by a forward hub threadingly secured to one end of the tie shaft 36. The second clamping member 44 is provided by an aft hub mounted to another portion of the tie shaft 36 to clamp the rotors 38 between the forward and aft hubs. A nut 50 that is threadingly tightened onto a threaded surface 49 of the tie shaft 36 during assembly will induce the necessary clamping preload into the rotors stack.

The second clamping member 44, in one example, includes first and second legs 52, 54 secured to one another at a joint 60. The nut 50 prevents rolling of the lower portion of the first leg 52 that could lead to loss of radial reaction between the second clamping member 44 and tie shaft 36 that in turn could lead to vibrations. In the example, the first and second legs 52, 54 are integral with one another to provide a unitary structure. A second end 56 of the first leg 52 is provided opposite the first end 48. The second end 56 abuts the aft-most rotor 38D. The second leg 54 extends generally in the axial direction and includes a third end 58 that engages the turbine rotor 62 to provide it's clamping to the high pressure compressor section 24. The main preload path goes through the second leg 54 and the upper portion of the first leg 52. The lower portion of the first leg 52 provides a midspan support for the compressor section 24 and turbine section 26 between high spool bearings (not shown) and the interface for nut 50 that is used during high pressure compressor assembly to create a temporary preload prior to application of the final preload through the main preload path. A nut 65 clamps the turbine rotors 62, 63 to the second leg 54 along the main preload path The tie shaft arrangement relies upon a combination of axial and radial clamping loads to transmit torque between the hubs, rotor and tie shaft, which reduces the overall clamping load typically used in the prior art in the entirely axial direction. To this end, the upper portion of first leg 52 is arranged on an angle B, which may be inclined 15-75° relative to the axis A to generate a radial load against the shaft 36 and prevent rolling. The lower portion of the first leg 52 provides a radial clamping load at the second end 56 and a radial load at the tie shaft interface. The geometry can encourage significant radial loads, which reduces the amount of axial clamping load, which lowers the contact stress in the upstream interfaces. The second leg 54 is at a relatively small angle relative to the axis A, and in the example, almost parallel.

Figure 3:
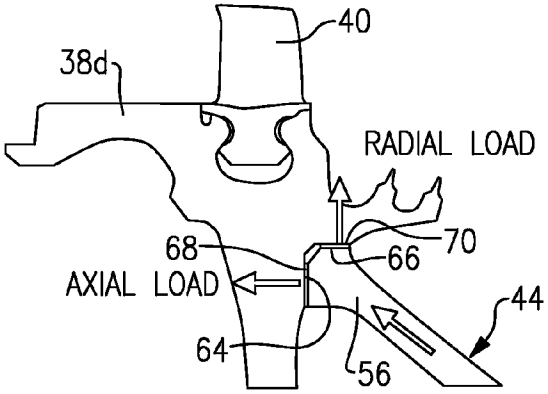
FIG. 3 is an enlarged view of a portion of the tie shaft arrangement shown in FIG. 2.

Referring to FIG. 3, the rotor 38D includes first and second rotor surfaces 64, 66, for example. The second end 56 includes first and second hub surfaces 68, 70 that respectively engage the first and second rotor surfaces 64, 66. The first rotor surface 64 is arranged radially inward of the second rotor surface 66, although the reverse arrangement may be used if desired. Torque transmission is accomplished by a combination of axial and radial friction between mating vertical faces subject to axial preload and snaps subject to radial loads derived from tight fits respectively. The configuration of the second clamping member 44 generates a radial load between rotor and hub surfaces 66, 70 that is 5-40%, for example, of the total design clamping load between the second end 56 and the rotor 38D in one example. As a result, the component sizes, thicknesses and/or masses in the tie shaft arrangement may be reduced as compared to a tie shaft arrangement that relies entirely on an axial clamping force.

Figure 4:
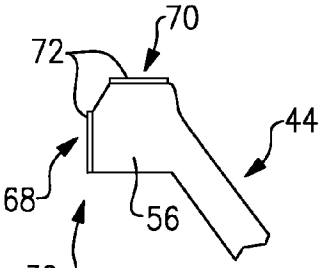
FIG. 4 is a further enlarged view of a portion of the tie shaft arrangement illustrating a friction modifier at an interface.

To further enhance torque transmission between adjacent components, a friction modifier may be used at the interfaces 39 to increase the friction of the base material, which is a nickel alloy, for example. The friction modifier may be provided, for example, by rough surface finishing, grit blasting, coatings, sprays, plasma, colloidal particles, adhesives, pastes and/or additives. Friction modifiers 72 are schematically illustrated on the first and second hub surfaces 68, 70 in the example shown in FIG. 4.

Although an example embodiment has been disclosed, a worker of ordinary skill in this art would recognize that certain modifications would come within the scope of the claims. For example, the disclosed tie shaft and clamping arrangement may be used for other turbomachines. Thus, the following claims should be studied to determine their true scope and content.

What is claimed is:

1. A turbomachine comprising:

a tie shaft extending along an axis;

multiple rotors mounted on the tie shaft;

first and second clamping members secured to the tie shaft and exerting a clamping load between the rotors and clamping members at multiple interfaces, the clamping load at one of the interfaces including a radial clamping load of greater than 5% of a total design clamping load at the one interface; and a friction modifier is provided at the interface, wherein the interface includes at least one of a rough surface finish, a grit blasted surface, a coating, a spray, a plasma, colloidal particles, adhesives, pastes and additives.

2. The turbomachine according to claim 1, wherein the radial clamping load is up to 40% of the total design clamping load with a balance of the total clamping load comprising an axial clamping load.

3. The turbomachine according to claim 1, wherein the tie shaft is a high pressure spool.

4. The turbomachine according to claim 3, wherein the rotors are high pressure compressor rotors.

5. The turbomachine according to claim 1, wherein one of the rotors includes first and second rotor surfaces respectively providing radially and axially extending surfaces, the radial clamping load exerted on the second rotor surface.

6. The turbomachine according to claim 5, wherein the first rotor surface is arranged radially inward of the second rotor surface.

7. The turbomachine according to claim 5, wherein one of the first and second clamping members is a hub providing first and second hub surfaces respectively engaging the first and second rotor surfaces to produce the total clamping load.

8. The turbomachine according to claim 7, wherein the hub includes a first leg having opposing first and second ends, the second end providing the first and second hub surfaces, the first end providing a flange supported by the tie shaft.

9. The turbomachine according to claim 8, wherein the tie shaft includes a threaded surface, and comprising a nut secured to the threaded surface and configured to apply the clamping load through the first end.

10. The turbomachine according to claim 8, wherein the first leg is inclined between 15° and 75° relative to the axis and extending from the flange to the second end.

11. The turbomachine according to claim 8, wherein the hub includes a second leg joined to the first leg, the hub arranged between compressor and turbine sections and configured respectively to provide compressor and turbine clamping loads to the compressor and turbine sections.

12. A tie shaft clamping member comprising:

a hub including a first leg extending between first and second opposing ends, the first end providing a flange configured to be supported by a tie shaft, and the second end including first and second hub surfaces respectively extending in radial and axial directions, the first leg inclined between 15° and 75° relative to the axial direction and extending from the flange to the second end; and a friction modifier is provided on at least one of the first and second hub surfaces, wherein the at least one of the first and second hub surfaces includes at least one of a rough surface finish, a grit blasted surface, a coating, a spray, a plasma, colloidal particles, adhesives, pastes and additives.

13. The tie shaft clamping member according to claim 12, wherein the hub includes a second leg integral with the first leg and extending generally in the axial direction from a joint arranged between the first and second ends to a third end.

* * * * *

UNITED STATES PATENT AND TRADEMARK OFFICE

CERTIFICATE OF CORRECTION

PATENT NO. : 9,121,280 B2
APPLICATION NO. : 13/442078
DATED : September 1, 2015
INVENTOR(S) : Benjamin et al.

It is certified that error appears in the above-identified patent and that said Letters Patent is hereby corrected as shown below:

Title Page, Item (75) Inventor is corrected to read:
-- Daniel Benjamin, Simsbury (CT);
Brian C. Lund, Moodus (CT);
Hans-Peter Hackenberg, Olching (DE);
Werner Humhauser, Moosburg (DE);
Eberhard Knodel, Jetzendorf-Priel (DE) --.

Signed and Sealed this
Twenty-sixth Day of July, 2016

Michelle K. Lee

Michelle K. Lee
*Director of the United States Patent and Trademark Office*